US006599042B2

(12) United States Patent
Wolf

(10) Patent No.: US 6,599,042 B2
(45) Date of Patent: Jul. 29, 2003

(54) DEVICE FOR CONTROLLING A TRANSPORT OF PRINTING PRODUCTS BY A PRINT-RELATED MACHINE

(75) Inventor: Thomas Wolf, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/935,504

(22) Filed: Aug. 23, 2001

(65) Prior Publication Data

US 2002/0041787 A1 Apr. 11, 2002

(30) Foreign Application Priority Data

Aug. 23, 2000 (DE) ..... 100 41 188

(51) Int. Cl.[7] ..... B41J 11/42
(52) U.S. Cl. ..... 400/582; 400/578; 400/708
(58) Field of Search ..... 400/582, 578, 400/708; 271/3.14–3.17, 4.02, 4.03, 10.02, 10.03, 227, 264–265.04, 152, 153, 154

(56) References Cited

U.S. PATENT DOCUMENTS 5,936,656 A * 8/1999 Yamaguchi ..... 347/234
5,992,973 A * 11/1999 Wen ..... 347/19

FOREIGN PATENT DOCUMENTS

DE 43 21 179 A1 1/1995
DE 195 09 962 A1 9/1996
DE 195 21 551 C2 11/1998
JP 58-168942 * 10/1983

OTHER PUBLICATIONS

Reinhard Feiel: "Veränderung der Laserspeckles bei Materialdehung" [changing of laser speckles when material is stretched], http://online.tu–graz.ac.at/tug online g/forschung/FA F159 2324 g.html.
Andreas Ciossek et al.: "In–Process Surface Roughness Measurement", http://www.msr.uni–bremen.de/andreas/cio 998.htm.
Yoshida et al.: "Phase Unwrapping for Dual–Beam Electronic Speckle Pattern Interferometry: Method", Optical Society of America, vol. 36, No. 1, dated Jan. 1, 1997, pp. 266–270.

* cited by examiner

*Primary Examiner*—Andrew H. Hirshfeld
*Assistant Examiner*—Minh Chau
(74) *Attorney, Agent, or Firm*—Laurence A. Greenberg; Werner H. Stemer; Ralph E. Locher

(57) ABSTRACT

A device for controlling the transport of a printing product by a print-related machine includes at least one locally stationary photoelectric detector having a light transmitter, by which light is directed at a surface of the printing product, and at least one light receiver for detecting the light remitted from the surface, a device for evaluating the remitted light, the evaluating device having computational equipment connected to adjustment elements for controlling the effect of a cyclically operating transporting device, the light transmitter including a light source for transmitting coherent light, and the light receiver including an element for recording the spatial distribution of the stray light, a timing device provided for synchronizing the instant of time of the recording with the cycle of the transporting device, and the evaluation device having a comparator for the local distribution of the stray light at the instant of time of the recording provided with a prescribed distribution.

2 Claims, 3 Drawing Sheets

DEVICE FOR CONTROLLING A TRANSPORT OF PRINTING PRODUCTS BY A PRINT-RELATED MACHINE

BACKGROUND OF THE INVENTION

Field of the Invention

The invention relates to a device for controlling a transport of printing products by a print-related machine.

For controlling and regulating sheet-feeding into a printing machine, and advancing or conveying sheets through a printing machine, it has become known heretofore to provide stationary photoelectric detectors in the conveyance path of the sheets, which operate by reflection or by transmitted light. In this regard, both sheet edges as well as markers that were specifically applied for the control or regulation can be detected. Furthermore, photoelectric detectors have become known heretofore which detect the entire surface of a printing product, adjustment values for adjustment elements being differentiated from received image signals, and serving to control the position of a printing image on the printing product, the position of colors that are to be printed overlappingly onto the printing product, and the thickness of the layers of colors that have to be printed overlappingly (note the published German Patent Document DE 43 21 179 A1).

Heretoforeknown devices of this general type have the disadvantage that they are not applicable for a wide variety of printed-material types. The application of additional markers limits the printable area that is available. Those devices, which are constructed for several types of printed material, usually include detectors based on different physical principals. Such detectors require considerable material and are costly.

In U.S. Pat. No. 5,689,757, a device for measuring the roughness of printed materials is described. The roughness is determined by two detectors which detect the intensity of reflected and dispersed measuring light. The measurement value for the roughness serves for setting parameters of an electrographic machine.

For examining the surface characteristics of materials, it has become known heretofore to examine the surfaces with coherent laser light.

The topography and the micro-roughness distribution, respectively, located on the surface at the location of the measuring light causes stray light, which can be recorded with a camera. An incident measuring-lightwave train is modified with reflections on a surface in phase and amplitude. Due to a superimposition of reflecting wave trains, a stray-light distribution is created, which is characteristic for the surface topography. This phenomenon is described as speckles effect. For each element of the surface, a characteristic black-and-white pattern, a so-called speckle pattern, is created. Speckle images can be analyzed or evaluated with the aid of digital image processing through mathematical correlation procedures. By joining the speckle pattern with the characteristic micro-roughness distribution of the viewed surface element, a shifting of the surface in the space leads to an adequate shifting of the speckle pattern in the space. On the Internet, according to http://online.tugraz.ac.at/tug online g/forschung/FA F159 2324 g.html on Sep. 8, 1999, a device for measuring the expansion or extension of the material has been described, with which the context of the shifting of a correlation-maximum was examined together with the real or actual shifting of a sample.

In the published German Patent Document DE 195 09 962 A1, a method is described for determining all three spatial components of a shifting-vector field of an object-surface, wherein a method for pattern matching for determining two components of the shifting-vector field is combined with a method for comparing contours of the object for determining the third component.

On the Internet on Sep. 8, 1999 according to http://www.msr.uni-bremen.de/andreas/cio 998. htm, a device for measuring the surface-roughness was described, wherein a CCD-camera was used to record a polychromatic stray-light speckle pattern, which allows a short-term recording with an exposure time of 1/500,000 second or less.

The foregoing stray-light measuring devices were either laid-open for measurements with samples at rest or for measurement with moving samples, the movement of the sample during the image recording being considered to be unwanted and being calculated out accordingly.

SUMMARY OF THE INVENTION

It is accordingly an object of the invention to provide a device for controlling a transport of printing products through a print-related machine, which is able to be used for a wide variety of materials and which allows a determination of the position of the printing product or of individual surface-elements of the printing product during movement thereof.

With the foregoing and other objects in view, there is provided, in accordance with the invention, a device for controlling the transport of a printing product by a print-related machine, comprising at least one locally stationary photoelectric detector having a light transmitter, by which light is directed at a surface of the printing product, and at least one light receiver for detecting the light remitted from the surface, and a device for evaluating the remitted light, the evaluating device having computational equipment connected to adjustment elements for controlling the effect of a cyclically operating transport device, the light transmitter including a light source for transmitting coherent light, the light receiver including an element for recording a spatial distribution of stray light, and a timing device provided for synchronizing the instant of time of the recording with the cycle of the transporting device, the evaluation device having a comparator for local distribution of the stray light with a prescribed distribution at the instant of time of the recording.

In accordance with a concomitant feature of the invention, the recording element is one of an optical CCD-area and CCD-line and an arrangement of single photo-diodes, respectively.

Due to the lighting with laser light of an area of a printing product, there is created, as a result of the roughness of the printing product, a characteristic gray-value distribution in the form of a pattern with light and dark speckle-points. The size of the speckles depends upon the roughness of the surface and upon the aperture of the optic system of the light-receivers. By modifying the aperture and the diameter, respectively, of an aperture diaphragm, via the spectrum of all printed materials and all printed-material roughnesses, respectively, an optimal point-extension or expansion of the speckles can be set for the light receiver. By a reduction in the width of the diaphragm aperture of a receiver-lens, speckles which are very large can also be created with smooth printed-material surfaces, as would otherwise only be formed for roughened surfaces. A defined roughness is present at a predetermined location on the printing product, which results in a characteristic speckle-image. The characteristic speckle-image can only be seen in the light-receiver, but not on the printing product. A shifting of the lit-up area of the printing product results in a shifting of the speckles in the space. This shifting-vector can be determined in different ways, for example, with methods for pattern-recognition. If a line-shaped light-receiver is used, then, with a shifting of the printing product, a given or determined speckle is located at a different position of the sensor-line. The invention can serve for determining the register of a printing-image on the printing product and for position-recognition of the printing product. If the device is directed onto a printed material web, one can then deduce the speed and the acceleration of the web from the timely diversions of the speckle shifts. Applications for monitoring the web flow and for web-tear control result therefrom. From spatial diversions of the shifting, values for the web-extension or web-tension are obtained.

The invention is applicable for printing machines for processing or conveying sheets or webs.

Other features which are considered as characteristic for the invention are set forth in the appended claims.

Although the invention is illustrated and described herein as embodied in a device for controlling a transport of printing products through a print-related machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, where in:

DESCRIPTION OF THE PREFERRED EMBODIMENTS

Figure 1:
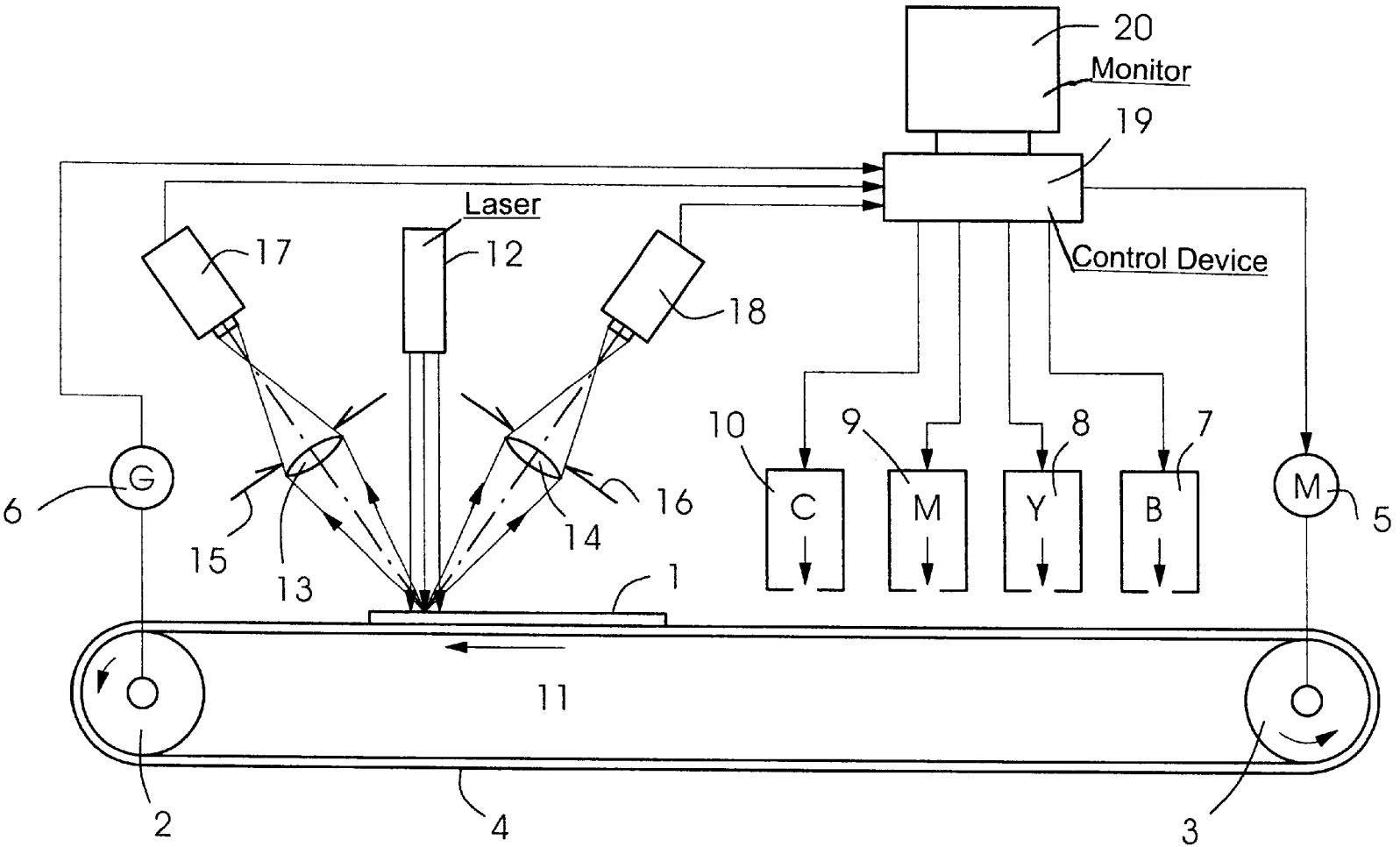
FIG. 1 is a diagrammatic and schematic side elevational view of a printing device with a device for speckles detection, in accordance with the invention.

Referring now to the drawings and, first, particularly to FIG. 1 thereof, there is shown therein a printing device including a transport or conveyor device for a sheet 1, having a conveyor belt 4 revolving around guide rollers 2 and 3. A motor 5 coupled with the guide roller 3 is provided as the drive for the transport or conveyor belt 4. A rotary transmitter 6 determines the rotary position of the guide roller 2. To print the sheet 1, four printing units 7 to 10 are provided alongside the upper strand of the transport or conveyor belt 4. As viewed in the transport direction represented by the horizontal arrow 11, a photoelectric device is disposed downline from the last printing unit 10, the photoelectric device including, as a light transmitter, a laser 12, and two light-detectors, each of which is formed of an objective 13, 14, an aperture diaphragm 15, 16 and a CCD-camera 17, 18, respectively. The outputs of the CCD-camera 17,18 are connected to a control device 19 containing computer-related hardware, which allows the processing of a digital image. A monitor or screen 20 permits a visualization of the results from the image processing. For controlling and regulating the printing process and the transport process, the control device 19 is connected to the printing units 7 to 10 and to the motor 5. The output of the rotary transmitter 6 is also connected to the control device 19.

The printed sheet 1 rests firmly on top of the transport or conveyor belt 4 during transport. From the signals of the rotary transmitter 6, signals are diverted in the control device 19 for positioning the sheet 1 on the transport or conveyor belt 4. When the sheet 1 has reached a given position, the brightness distribution of a speckle stray-light pattern is recorded by the photoelectric device, the speckle stray-light pattern being formed when an area of the surface of the sheet 1 is illuminated with the coherent measuring light of the laser 12. The distribution of the speckle stray-light pattern existing at the instant of time of the recording is compared with a target or nominal stray-light pattern in the control device 19. If there is an impermissible deviation between the existing pattern and the target or nominal pattern, control signals can then be diverted in the control device 19, which control the transport of sheet 1 on the transport or conveyor belt 4 and the imaging of the sheet 1 by the printing units 7 to 10, so that the position of a printing image on the sheet 1 and the position of the partial-images which are to be printed overlappingly or over one another by the printing units 7 to 10 can be changed relative to one another, as desired.

In light of the following versions or modes, the basic processes in the determination of the changes or modifications of the shape and location, respectively, of a printed material or of a conveyor-belt advancing or conveying a sheet are explained.

Figure 2:
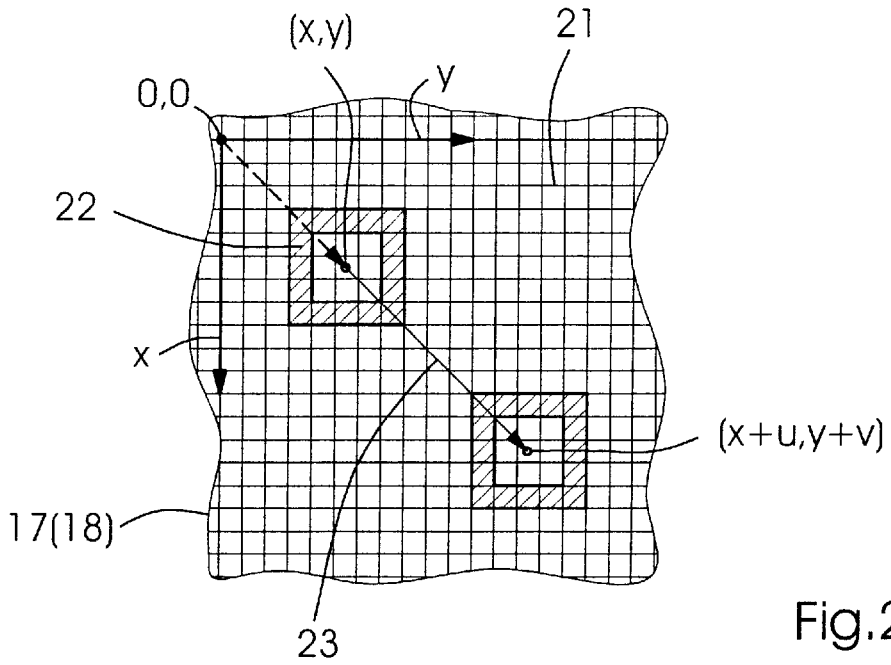
FIG. 2 is a schematic drawing for speckles analysis.

In FIG. 2, a detail of a matrix-shaped receiver-area of a CCD-camera 17, 18 is portrayed. Receiver elements 21 which are arranged in lines and columns lie in coordinate directions x, y of a rectangular coordinate system. For an exemplary or model-like representation of the lighting conditions of the receiver elements with stray light during transport of the sheet 1, a square frame 22 is portrayed in the receiver area in two different positions at two different instants of time $t_1$, $t_2$. At the instant of time $t_1$, the location of the portrayed frame 22 is described using the shaded radius vector (x, y). At the instant of time $t_2$, the frame 22 lies at the coordinates (x+u), (y+v). This translation is described by the shifting vector 23.

From the quotients $$\frac{u}{t_2 - t_1},$$

the velocity component of the sheet 1 and of the frame 22, respectively, can be determined in the x-direction, and from the quotients $$\frac{v}{t_2 - t_1},$$

it can be determined in the y-direction.

Figure 3:
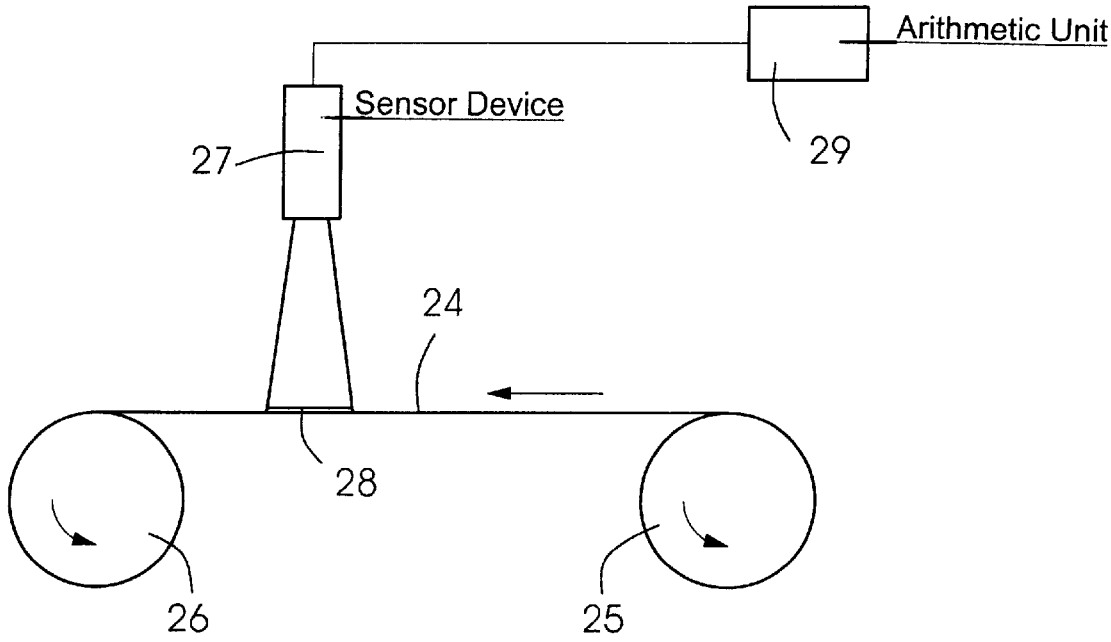
FIG. 3 is a diagrammatic side elevational view of a device according to the invention for measuring web expansion or extension.

In FIG. 3, an application for measuring the expansion or extension of a web 24 is shown, which, during printing, with the aid of drives, is unwound from a roll 25, and wound up on a roll 26. With the aid of a lighting and sensor device 27, a section 28 of the surface of the web 24 is illuminated and, as described in FIG. 2 as a model or as exemplary, the shifting of the stray-light pattern originating from the section 28, at two different instants of time $t_1$, $t_2$ is determined with the aid of an arithmetic unit or computer 29. From the local diversions of the determined shifting vectors 23, the expansion or elongation $\epsilon$ can be determined with the aid of the arithmetic unit or computer 29. In case the expansion or extension $\epsilon$ exceeds a permissible extent, a signal can be diverted for an impending web tear. Because it is possible with this device to determine the web tension running via the expansion or elongation $\epsilon$, the latter can be used to regulate the web tension to a desired extent.

Another possible application results in the measurement of the velocity of the web 24. The velocity of the web 24 results from the knowledge of the shifting-vector component u used in FIG. 2, while creating the quotient $$\frac{u}{t_2 - t_1}.$$

Figure 4:
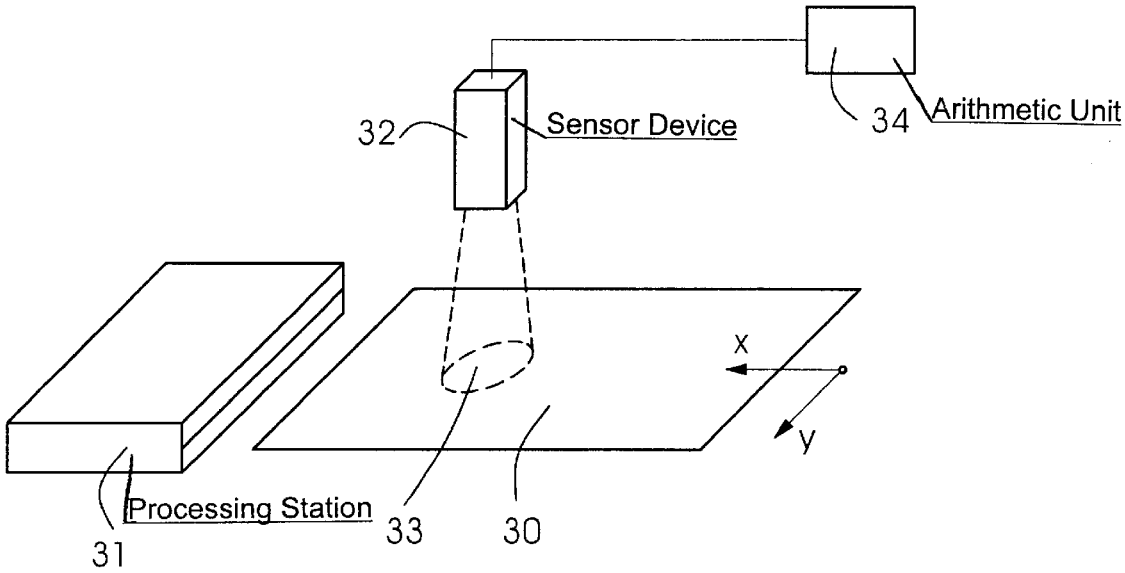
FIG. 4 is a diagrammatic side elevational view of a device according to the invention for determining or registering an inclined or angular position of a printed material.

FIG. 4 illustrates a further application for determining the inclined or angular position of a sheet 30 as it is advanced or conveyed in the x-direction to a print-related processing station 31. Instead of the sheet 30, the inclined or angular position of a web that is to be processed can be determined. With a lighting and sensor device 32, a section 33 of the sheet 30 is illuminated and, from the stray light, as in FIG. 2 described as exemplary or as a model, through the intermediary of an arithmetic unit or computer 34, the shifting-vector component (u, v) is determined. The lighting and sensor device is installed so that, for correct travel of the sheets in the x-direction, which means, with the lateral edges of the sheet 30 lying parallel to the x-direction, the component v of the shifting-vector (u, v) in the y-direction equals zero. For a sloping or inclined travel of the sheets, a component v which is not equal to zero appears. The angular or inclined position is calculated with the aid of the arithmetic unit or computer from the components u and v by a simple geometric relation.

This method for determining the angular or inclined position of a sheet 30 can be used while feeding-in the sheet 30 into the processing station 31, or while advancing or conveying the sheet 30 into the processing station 31, especially while advancing or conveying with grippers. While advancing or conveying the sheet 30 with grippers, it is possible to determine the angular or inclined position of the sheet 30 held at the leading edge thereof and to adjust it by actuators.

When the method is applied in a web-processing machine, the angular or inclined position of the web can be determined for diverting signals which serve for controlling the take-up or wind-up process.

I claim:

1. A device for controlling transportation of a printing product by a print-related machine, comprising:

at least one locally stationary photoelectric detector including a light transmitter for transmitting coherent light toward a surface of the printing product, and at least one light detector including an element for detecting a speckle stray-light pattern of stray light remitted from the surface of the printing product; and a control device for obtaining a deviation by comparing the speckle stray-light pattern of the stray light that has been detected with a target stray-light pattern;

said control device also being for appropriately controlling a transport device, if said deviation is impermissible.

2. The transport controlling device according to claim 1, wherein said element of said light detector is a component selected from a group consisting of an optical CCD-area, a CCD-line, and a configuration of single photo-diodes.

* * * * *